United States Patent [19]

Mach

[11] 4,405,012

[45] Sep. 20, 1983

[54] DEVICE TO POSITION COMPONENTS OF SHELL AND TUBE HEAT EXCHANGER

[76] Inventor: Joe A. Mach, Rte. 1, Box 133, Talala, Okla. 74080

[21] Appl. No.: 267,003

[22] Filed: May 26, 1981

[51] Int. Cl.[3] ..... F28F 7/00

[52] U.S. Cl. ..... 165/78; 29/157.3 R

[58] Field of Search ..... 165/78; 29/157.3 R

[56] References Cited

U.S. PATENT DOCUMENTS 2,084,324 6/1937 Dewald ..... 165/78

2,259,604 10/1941 Banks ..... 165/78

*Primary Examiner*—Albert W. Davis, Jr.

*Assistant Examiner*—John F. McNally

*Attorney, Agent, or Firm*—Head, Johnson & Stevenson

[57] ABSTRACT

A device for relative orientation of the components of a shell and tube type heat exchanger and comprising complementary sleeve and guide pins provided on mating components of the heat exchanger particularly arranged and positioned whereby the insertion of the guide pins within the respective sleeves during the assembly of the heat exchanger will assure the proper rotational orientation between the components for an efficient internal sealing of the heat exchanger for increasing the operating efficiency thereof and reducing the assembly time for the apparatus.

4 Claims, 8 Drawing Figures

DEVICE TO POSITION COMPONENTS OF SHELL AND TUBE HEAT EXCHANGER

BACKGROUND OF THE INVENTION

1. Field of the Invention

This invention relates to improvements in heat exchangers and more particularly, but not by way of limitation, to a device for facilitating the positioning of the components during the assembly of a shell and tube heat exchanger.

2. Description of the Prior Art

Heat exchangers of the shell and tube type normally comprise an outer shell having a tube bundle mounted therein in such a manner that the opposite ends of the tube members are open for directing a flow of fluid through the tubes in a circuitous path for providing an efficient heat exchange operation. The open ends of the tubes are in communication with a plurality of individual compartments provided at each end of the shell, and it is important that each of these compartments be sealed from the other compartment to preclude leakage of fluid therebetween. It is the usual practice to interpose sealing members between abutting flange members or head members which define the compartments to assure the efficient sealing therebetween, but since these sealing members are normally disposed interiorly of the shell, access to the sealing members is quite limited, and the proper alignment of the sealing members with the sealing surface is very difficult. It is thus difficult to assemble the heat exchanger in a manner to provide the most efficient operation thereof.

SUMMARY OF THE INVENTION

The present invention contemplates a novel means for facilitating the alignment of the components of a shell and the tube type heat exchanger during the assembly thereof for assuring an efficient alignment between the sealing members and the sealing surfaces to produce an increased efficiency for the operation of the heat exchanger. The novel device comprises alignment pin means and complementary sleeve means provided on the mating components of the heat exchanger for efficiently guiding the assembly thereof in the proper mutual alignment therebetween. In the normal asembly operation, one end of the tube bundle is positioned against the external flange of the shell, with the tube sheet being disposed in abuttment with the flange, and a sealing means interposed between the tube sheet and flange. The radial orientation of the tube sheet with respect to the flange is important for assuring a proper sealing at the flange end for sealing of the individual compartments provided outboard of the tube bundle. In order to assure the proper orientation between the tube sheet and the flange a plurality of circumferentially spaced sleeve or tube members are secured to the outer periphery of the flange for slideably receiving complementary guide pins secured to the outer periphery of the tube sheet. The shell is then telescoped over the tube bundle and secured to the flange, with the tube sheet being sandwiched between the shell and the flange. Again, it is important that the radial orientation of the shell with respect to the flange be maintained for assuring a proper alignment between the components of the heat exchanger at the opposite end thereof. Thus, complementary tube and guide pin means is provided between the flange and the shell for facilitating the proper orientation therebetween during the assembly operation. The internal head means at the opposite end of the tube bundle is then positioned in abutting arrangement with the outboard tube sheet, and here again complementary sleeves or tube members and guide pins are secured to the outboard flange of the shell and internal head means for assuring a proper alignment between the components for assuring that the sealing means interposed between the internal head and outboard tube sheet are properly aligned for an efficient sealing of the fluid compartments provided in the internal head means. The pin members provided on the internal head means are removable, and upon the installation of the internal head means, the guide pins are removed therefrom. The external head member may then be moved into a position of abuttment with the outboard flange means of the shell, and guide pin means corresponding to the tube members on the outboard flange are provided for the external head means for facilitating the concentrical alignment between the external and internal head members. This is important because of the relatively close peripheral tolerances normally provided between the two head members, and if the outer component is not accurately aligned with the inner component, there may be a bindng therebetween which hinders the assembly of the apparatus. The novel means for assuring an efficient alignment between the components of the heat exchanger during the assembly thereof is simple and efficient in operation and economical and durable in construction.

DETAILED DESCRIPTION OF THE PREFERRED EMBODIMENT

Figure 1:
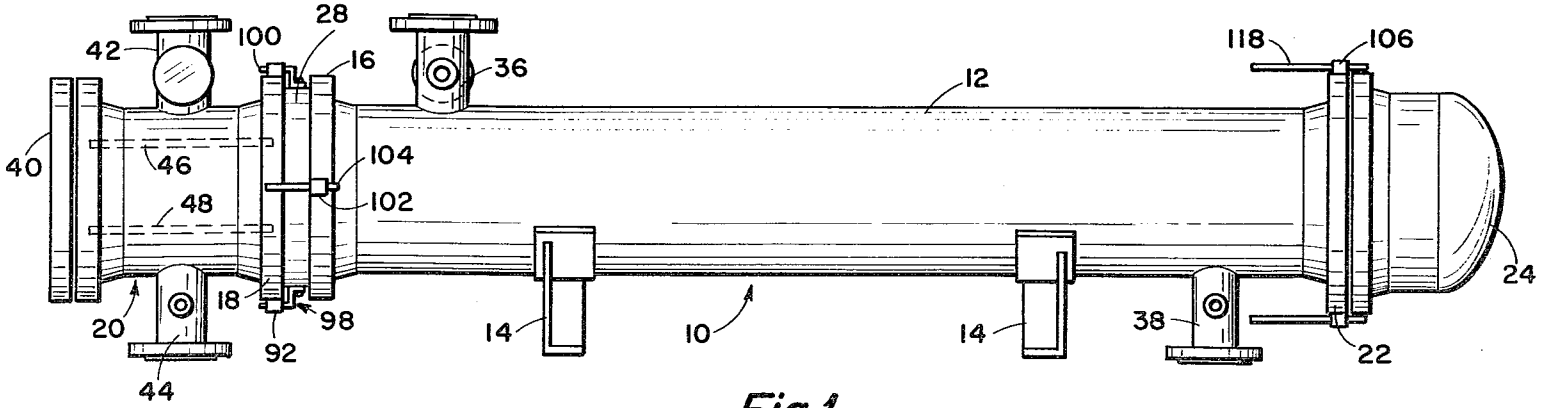
FIG. 1 is a side elevational view of a shell and tube type heat exchanger provided with the novel assembly guide means of the invention.
Figure 3:
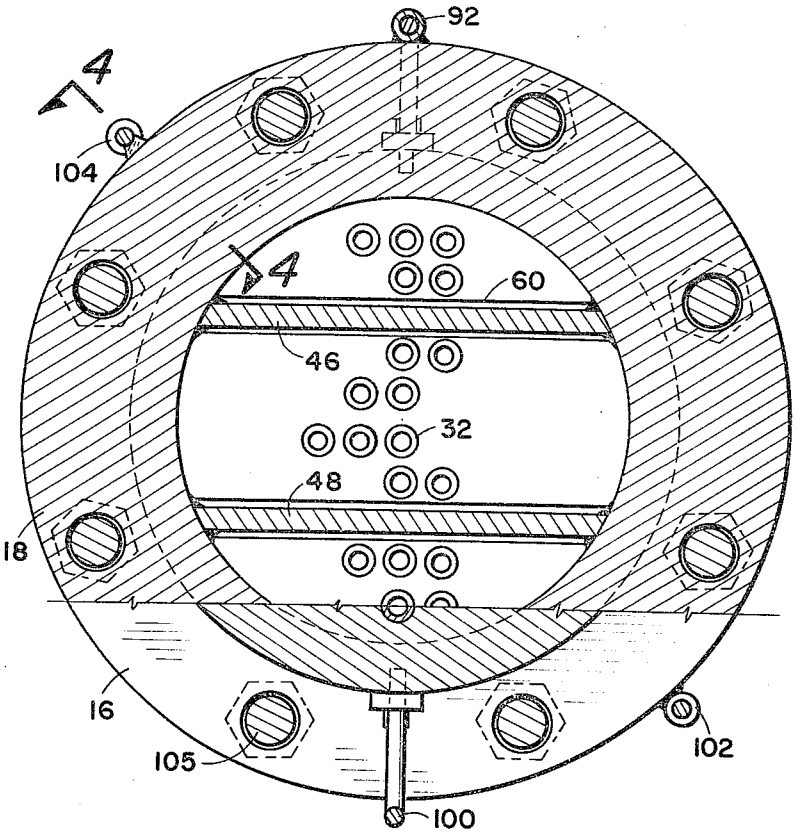
FIG. 3 is a view taken on line 3—3 of FIG. 2.

Referring to the drawings in detail, reference character 10 generally indicates a shell and tube type heat exchanger comprising a substantially cylindrical outer shell 12 which is shown herein supported in a substantially horizontal position by suitable support cradles 14. It is to be understood, however, that the shell may be supported in substantially any position, as for example, a substantially vertical position, as desired. A first flange means 16 is provided at one end of the shell 12, as is well known, for operable connection with the usual external flange 18 of a suitable chemical fluid receiving housing 20, as will be hereinafter set forth. A second flange means 22 is provided at the opposite end of the shell 12 for operable connection with the usual external head 24 which closes the outer end of the shell 12. A tube bundle generally indicated at 26 is disposed within the shell 12 and extends longitudinally therethrough. The tube bundle 26 normally comprises the usual spaced tube sheet members 28 and 30 having a plurality of spaced mutually parallel open ended tube members 32 extending therebetween. The first tube sheet 28 is normally interposed between the flanges 16 and 18 and in sealed abuttment with both, as will be hereinafter set forth, and the second tube sheet 30 is normally disposed outboard of the flange 22. An internally chambered inner head means 34 is secured to the outer face of the tube sheet 30, and the outer head means 24 encases the inner head means the tube sheet 30 as particularly shown in FIG. 8. Fluid inlet means 36 and fluid outlet means 38 are provided for the shell 12 and preferably interposed between the flanges 16 and 22 for directing an effluent into the shell 12 for accumulation about the outer periphery of the tubes 32 and for discharge of the effluent from the shell 12 during and subsequent to a heat exchange operation, as is well known and as will be hereinafter set forth in detail.

The inner end of the fluid receiving housing 20 is open to the open ends of the tubes 32 extending through the first tube sheet 28, and the outer end of the housing 20 is closed by suitable end plate means 40. A fluid inlet means 42 and fluid outlet port means 44 are provided for the housing 20 for admitting fluid thereto for a purpose as will be hereinafter set forth. In addition, internal baffles or partitions 46 and 48 are provided within the housing to form at least three individual or separate fluid compartments 50, 52 and 54. As shown herein, the fluid inlet port means 42 is in communication with the compartment 50 and the fluid outlet port means 44 is in communication with the fluid compartment 54. The inner ends of the partitions 46 and 48 normally extending into complementary recesses 56 and 58 provided in the outboard face of the tube sheet 28. The recesses 56 and 58 are preferably substantially mutually parallel and extend across the face of the tube sheet 28. A sealing means 60 is interposed between the partitions 46 and 48 and the tube sheet 28 as well as between the tube sheet 28 and the inboard face of the flange 18, as particularly shown in FIG. 2. The sealing means 60 is preferably of a generally annular configuration with a pair of spaced mutually parallel cross members extending there across for alignment with and disposition in the recesses 56 and 58 for efficiently precluding leakage of fluid from the chambers 50, 52 and 54. In addition, of course, it is preferable to provide a suitable sealing means or gasket 62 between the inboard face of the tube sheet 28 and the flange 16.

Figure 5:
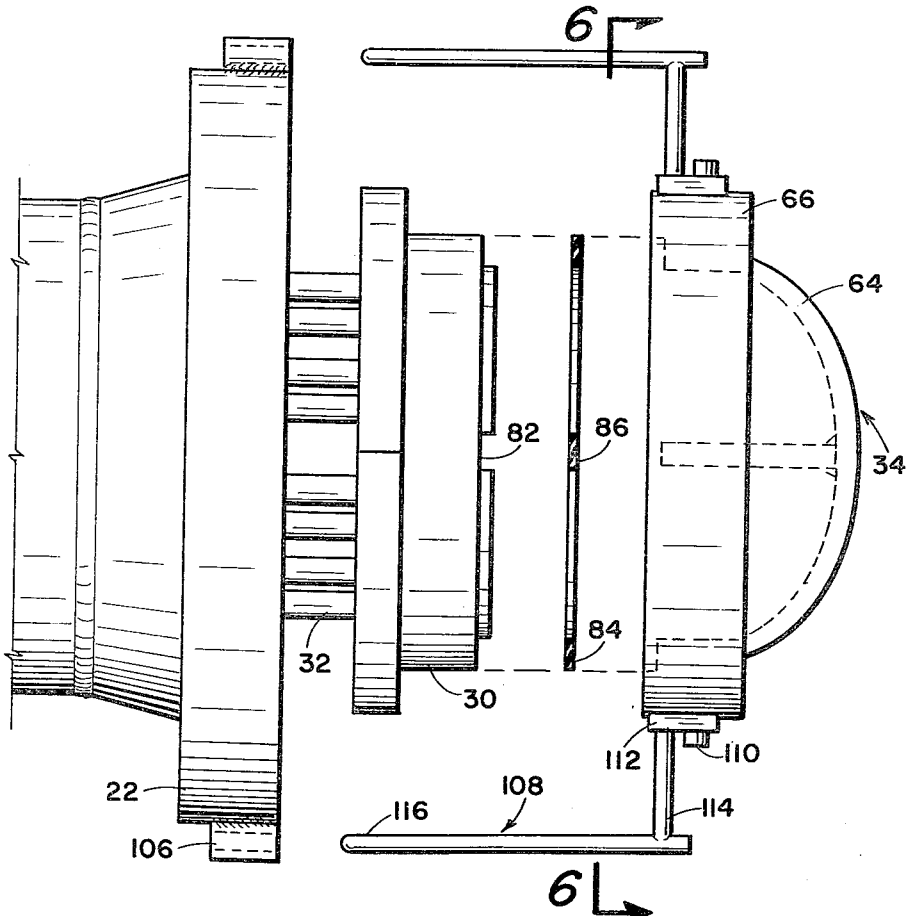
FIG. 5 is an exploded enlarged elevational view of the opposite end of the heat exchanger with respect to that shown in FIG. 1, and illustrates a further step in the assembly of the heat exchanger.
Figure 7:
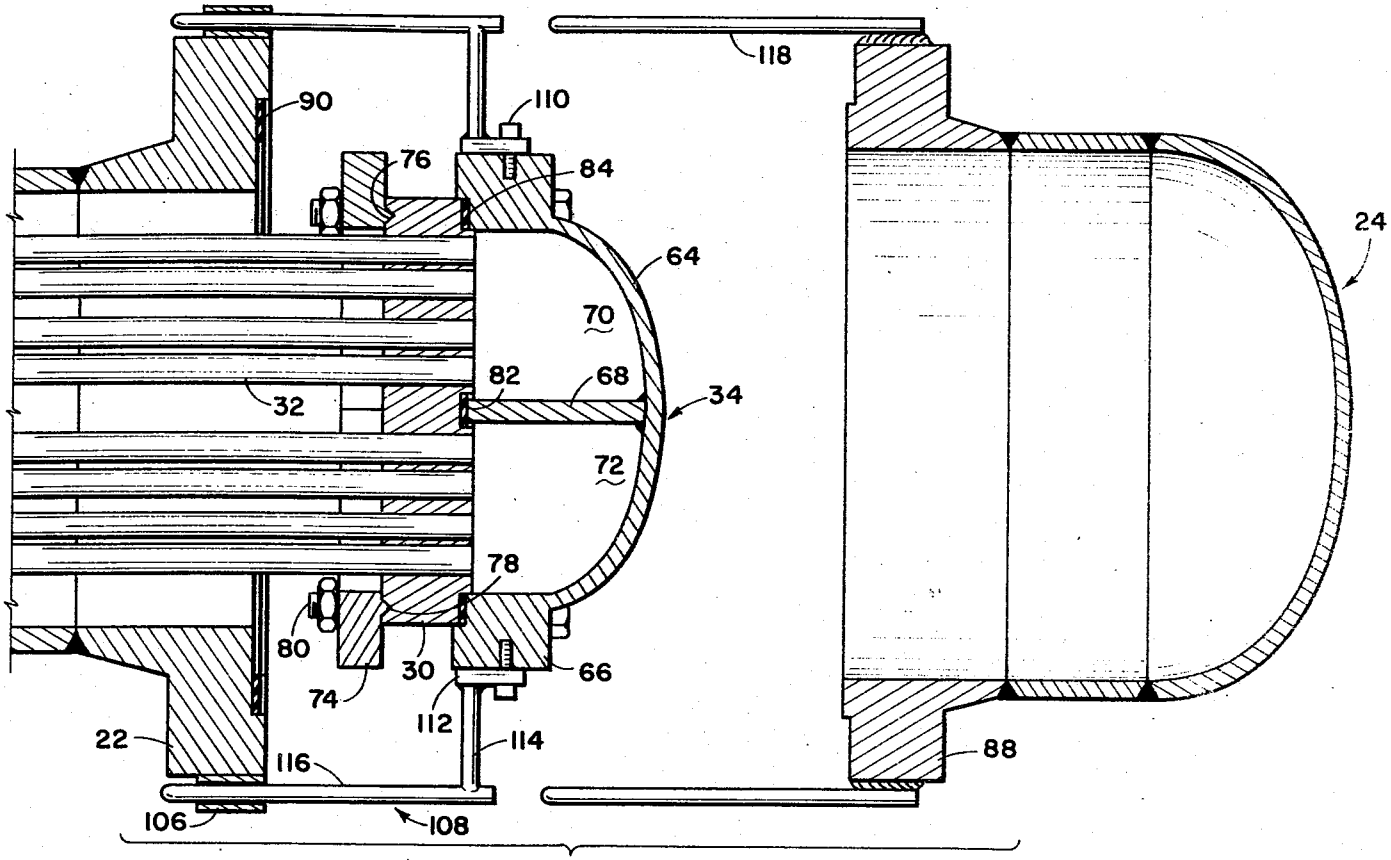
FIG. 7 is an exploded sectional elevational view of the end of the heat exchanger shown in FIG. 5, and illustrates a still further step in the assembly of the heat exchanger.

The inner head means 34 comprises a generally cone-shaped central portion 64 having an outwardly extending circumferential flange means 66 provided around the outer periphery thereof. A substantially centrally disposed diametrically extending baffle or partition member 68 is provided in the central member 68 for dividing the head means 34 into at least two internal compartments 70 and 72. The compartments 70 and 72 are open to the open ends of the tubes 32 extending through the second tube sheet member 30 as particularly shown in FIG. 7. A sectional annular ring or split rings 74 is disposed against the inboard face of the tube sheet 30, and an annular detent or recess 76 is provided on the tube sheet 30 for receiving a complementary annular projection means 78 provided on the ring 74 for assuring a proper concentrical alignment therebetween. A plurality of circumferentially spaced bolts 80 extends between the ring 74 and the flange 66 for tightly clamping the tube sheet 30 therebetween. A diametrically extending recess 82 is provided on the outboard face of the tube 30 for receiving the free end of the partition 68 therein, and a sealing means 84 is interposed between the tube sheet 30 and the inner head means 34 for precluding leakage of fluid therebetween. The sealing means 84 is generally similar to the sealing means 60, and is of a generally annular configuration with a diametrically extending strip 86 (FIG. 5) extending thereacross for disposition within the recess 82 in order to preclude leakage of fluid between the partition 68 and the tube sheet 30 for sealing of the chambers 70 and 72.

The outer head means 24 is preferably of a substantially cone-shaped configuration, and is provided with an outwardly extending circumferential flange 88 around the outer periphery thereof for an abutting engagement with the flange 22. A suitable sealing gasket 90 is interposed between the flange 88 and flange 22 for precluding leakage of fluid therebetween, as is well known. The inner periphery of the outer head member is normally of a close tolerance with the outer periphery of the flange 66 of the inner head 34 for added stability for the assembled heat exchanger 10.

It will be readily apparent that the sealing members provided in the heat exchanger 10, and particularly the sealing members 60 and 84 are essentially inaccessible during the assembly of the apparatus 10, and yet it is extremely important that the sealing members provide an efficient sealing for assuring a separation of the compartments 50, 52 and 54 as well as separation of the compartments 70 and 72 during operation of the heat exchanger 10. Accordingly, particularly designed and constructed complementary guide means is provided for facilitating the entire assembly operation, as will now be set forth in detail.

A pair of diametrically opposed tubes or sleeves 92 are welded or otherwise secured to the outer periphery of the flange 18 and are disposed in substantial parallel alignment with the longitudinal axis thereof. A pair of diametrically opposed blocks or plate members 94 are secured to the outer periphery of the tube sheet 28 in any suitable manner, such as bolts 96, or by welding, or the like, if desired. An L-shaped guide means 98 is rigidly secured to each plate 94 and extends radially outwardly therefrom. The outer end of each guide means 98 terminates in a guide pin 100 extending substantially parallel with respect to the longitudinal axis of the tube sheet 28 and in substantial axial alignment with the respective tube or sleeve 92. The relative position of the sleeves 92 and pins 100 is selected whereby the recesses 56 and 58 will be in alignment with the face ends of the partitions 46 and 48 when the guide pins 100 are in alignment with the sleeves 92. Thus, upon assembly of the tube sheet 28, the guide pins 100 are inserted within the respective tubes 92, thus assuring a proper rotational orientation therebetween.

A second pair of diametrically opposed tubes or sleeves 102 are welded or otherwise rigidly secured to the outer periphery of the flange 16, and disposed in substantially parallel alignment with respect to the longitudinal axis thereof. A pair of oppositely disposed guide pins 104 are welded or otherwise rigidly secured to the outer periphery of the flange 18 and disposed in substantial parallel alignment with the longitudinal axis thereof and in axial alignment with the respective sleeve 102 of the flange 18. The relative position of the pins 104 and sleeves 102 is particularly selected to assure the proper rotational alignment of the shell 12 with the tube needle 26 during the assembly of the apparatus 10. Of course, when the shell 12 has been properly orientated with respect to the flange 18, the flanges 16 and 18 may be bolted or otherwise secured together as is well known for sandwiching the tube sheet 28 therebetween.

A pair of diametrically opposed tubes or sleeves 106 are welded or otherwise rigidly secured to the outer periphery of the flange 22, and a pair of diametrically opposed guide assemblies 108 are removably secured to the outer periphery of the flange 66 of the inner head 34 in any suitable manner, such as by bolts 110. The guide assemblies 108 comprise a mounting plate means 112 having an arm 114 extending radially outwardly therefrom for supporting a guide pin 116 which is disposed in substantial parallel alignment with respect to the longitudinal axis of the inner head means 34 and in substantial axial alignment with the respective sleeve 106. The relative position of the pins 116 and respective sleeves 106 is particularly selected whereby the strip 86 of the seal member 84 will be in alignment with the recess 82 of the tube sheet 30 when the pins 116 are inserted within the respective sleeve 106, thus assuring an efficient sealing of the chambers 70 and 72.

Figure 8:
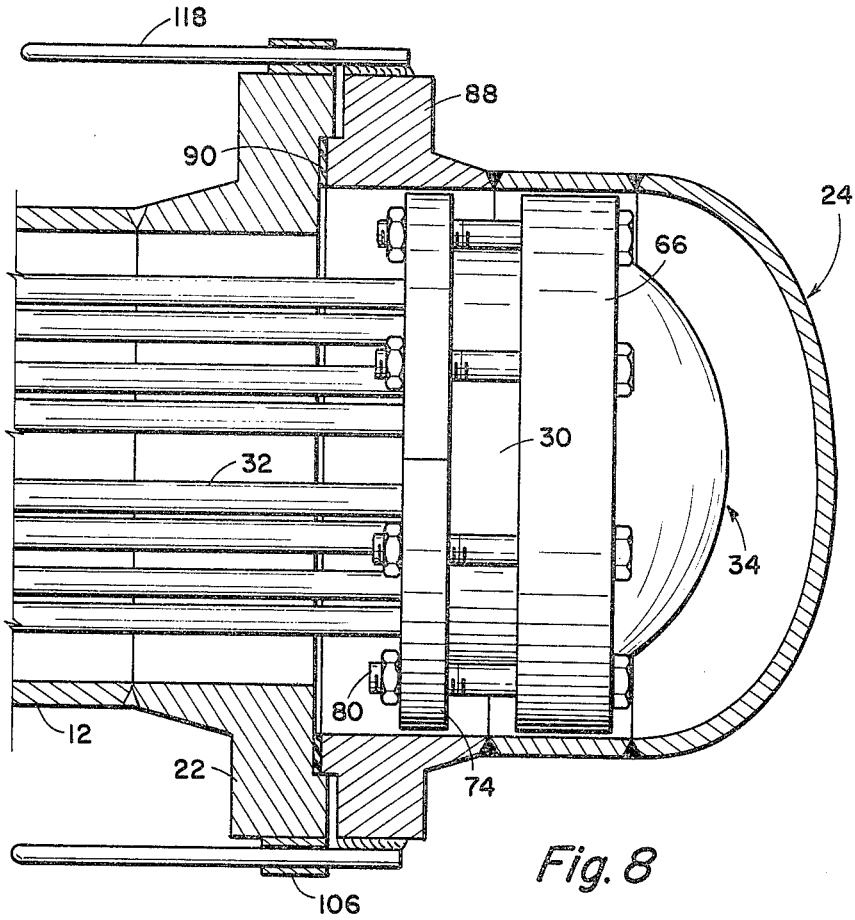
FIG. 8 is a view of the portion of the heat exchanger shown in FIG. 7 and illustrates the fully assembled condition thereof.
Figure 4:
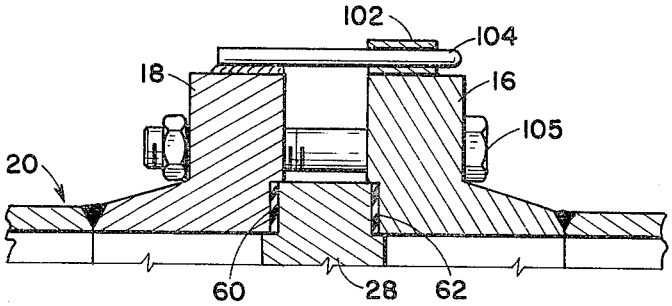
FIG. 4 is a view taken on line 4—4 of FIG. 3.
Figure 6:
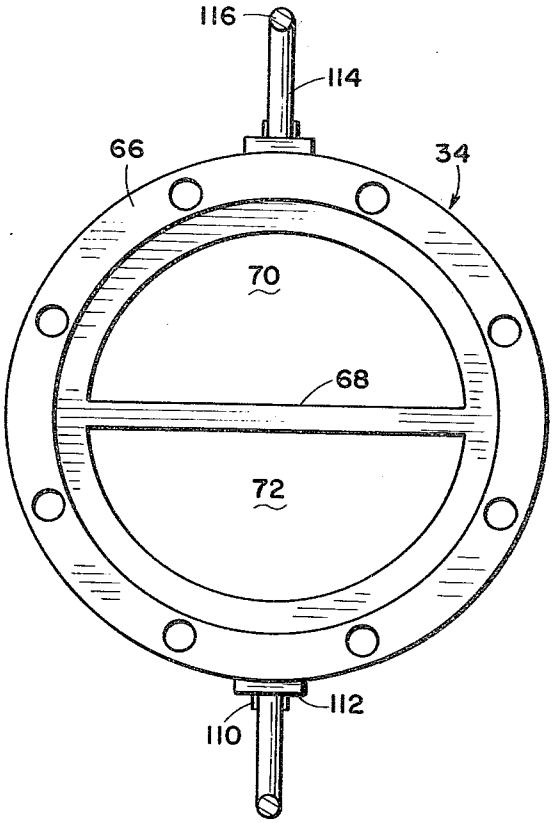
FIG. 6 is a view taken on line 6—6 of FIG. 5.

A pair of diametrically opposed guide pins 118 are welded or otherwise rigidly secured to the outer periphery of the flange 88 of the outer head means 24, as particularly shown in FIG. 8, and are disposed in substantial parallel relationship with respect to the longitudinal axis of the head 24 and in substantial axial alignment with the sleeves 106. When the inner head 34 has been properly aligned with respect to the flange 22, and bolted to the split ring 74 for sandwiching the tube sheet 30 therebetween, the guide pin assemblies 108 may be removed, and the guide pins 118 may be inserted through the respective sleeves 106 in lieu thereof for properly concentric orientation of the outer head 24 with respect to the inner head 34. This is of particular importance because of the relatively close tolerance between the inner periphery of the outer head 24 and the outer periphery of the inner head 34.

Figure 2:
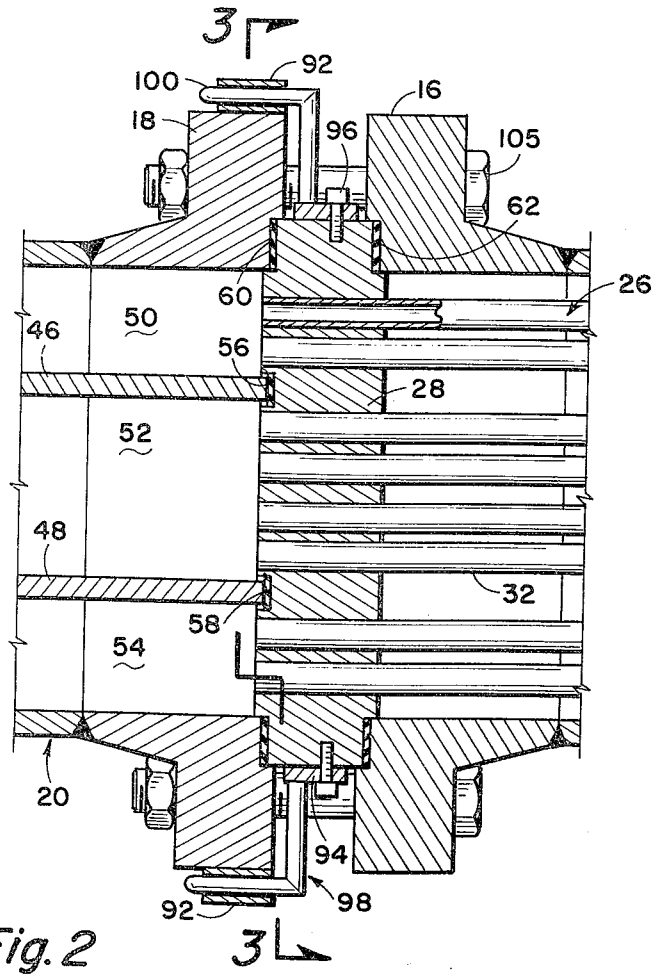
FIG. 2 is an enlarged sectional elevational view of a portion of one end of the heat exchanger shown in FIG. 1, and illustrates an initial step in the assembly of the heat exchanger.

In order to assemble the heat exchanger 10, the tube bundle 26 is initially disposed in engagement with the fluid housing 20 in such a manner that the first tube 28 is in abuttment with the flange 18 as shown in FIG. 2. The guide pins 100 may be readily inserted into and through the respective guide sleeves 92 to assure a proper rotational orientation between the tube sheet 28 and the flange 18 whereby the sealing means 60 provides an efficient sealing between the flange 18 and sheet 28 and between the sheet 28 and the partitions 46 and 48 and the outer face of the tube sheet 28. The shell 12 is then telescoped over the tube bundle 26 in such a manner that the flange 16 is brought into an abutting engagement with the tube sheet 28. The guide pins 104 are inserted through the respective guide sleeves 102 for assuring a proper rotational orientation of the shell 12 with respect to the tube bundle 26, and the fnalges 16 and 18 may be bolted together in the usual manner by a plurality of circumferentially spaced bolts 105.

The inner head means 34 may now be installed at the outer end of the tube sheet 30 and the guide pins 116 may be readily inserted into and through the guide sleeves 106 for assuring a proper rotational orientation between the head means 34 and the tube bundle 26 wherein the strip member 86 of the sealing means 84 will be in alignment with the recess 82 of the tube sheet 30, thus assuring an efficient sealing of the compartments 70 and 72. The split ring 74 may then be positioned in an abutting engagement with the inboard face of the tube sheet 30, with the annular projection 74 being disposed in the annular recess 76 for proper positioning of the ring means 74. The inner head means 34 may then be bolted to the ring means 74 for sandwiching the tube sheet 30 therebetween. The guide pin assemblies 108 may then be removed from the inner head means 34 and the outer head means 24 may be installed by inserting the guide pins 116 through the respective sleeves 106, and the flanges 22 and 88 disposed in abutting relationship, with the sealing gasket 90 providing an efficient seal therebetween.

In the operation of the heat exchanger 10, the heating of cooling effluent may be admitted into the interior of the shell 12 through the inlet port means 36 for accumulation around the outer periphery of the tubes 32 of the tube bundle 26 between the tube sheets 28 and 20. The fluid to be heated or cooled may be admitted into the fluid housing 20 through the fluid inlet 42 whereby the fluid initially enters the chamber 50. The fluid passes through the open end of the tubes 32 exposed in the chamber 50 and passes longitudinally through the tubes for discharges therefrom into the chamber 70 of the inner head means 34 and into the open ends of the next succeeding tubes open to the chamber 70. The fluid flows through the tubes in a reverse direction for entering the chamber 52 of the fluid housing 22 and moves into the exposed open ends of the next succeeding tubes for moving in a reverse direction therethrough for discharge into the chamber 72 of the inner head means 34. The fluid then moves through the next succeeding tubes open at the chamber 72 for discharge at the fluid chamber 54 of the housing 20, whereupon the heated or cooled fluid may be removed from the heat exchanger 10 through the discharge means 44.

From the foregoing it will be apparent that the present invention provides a novel guide means for facilitating the assembly of a heat exchanger whereby an efficient internal sealing is provided for the heat exchanger to increase the operating efficiency thereof. The guide means cooperates between the components of the heat exchanger during assembly thereof for readily assuring a proper orientation between the components and decreasing the time required for the overall assembly operation.

Whereas the present invention has been described in particular relation to the drawings attached hereto, it should be understood that other and further modifications, apart from those shown or suggested herein may be made within the spirit and scope of this invention.

What is claimed is:

1. Means for facilitating the relative operable radial orientation of the components of a shell and tube type heat exchanger during the assembly thereof and comprising guide pin means provided on selected components of the heat exchanger in preselected positions thereon, and complementary sleeve means provided on mating components of the heat exchanger for slidably receiving the guide pin means therein for assuring proper rotational and axial alignment orientation between the mating components.

2. Means as set forth in claim 1 wherein the guide pin means comprises axially extending guide pin members secured to said selected components in substantial alignment with the longitudinal axis thereof and in substantial axial alignment with the respective sleeve means of the mating component.

3. Means as set forth in claim 2 wherein at least a portion of the guide pin members are removably secured to the respective component for removal subsequent to the operable radial and axial alignment with the respective mating component.

4. Means as set forth in claim 1 wherein at least a portion of the guide pin means comprises mounting plate means engageable with the respective component, and L-shaped pin means being secured to the mounting plate means and terminating in a guide pin member disposed in substantial axial alignment with the respective sleeve means and substantially parallel with respect to the longitudinal axis of the component.

* * * * *